US008998006B2

(12) United States Patent
Taurins

(10) Patent No.: US 8,998,006 B2
(45) Date of Patent: Apr. 7, 2015

(54) FASHION ACCESSORIES HANGING SYSTEM

(76) Inventor: Ellen Taurins, Flushing, NY (US)

( * ) Notice: Subject to any disclaimer, the term of this patent is extended or adjusted under 35 U.S.C. 154(b) by 0 days.

(21) Appl. No.: 13/468,527

(22) Filed: May 10, 2012

(65) Prior Publication Data

US 2012/0285913 A1 Nov. 15, 2012

Related U.S. Application Data

(60) Provisional application No. 61/484,282, filed on May 10, 2011.

(51) Int. Cl.

| | |
|---|---|
| ***A47F 7/00*** | (2006.01) |
| ***A47G 25/74*** | (2006.01) |
| ***A47F 5/00*** | (2006.01) |

(52) U.S. Cl.

CPC ..... *A47G 25/74* (2013.01); *A47F 5/0006* (2013.01)

(58) Field of Classification Search

CPC ..... A47H 13/00; A47H 13/01; A47H 13/02; A47H 13/04; A47H 15/00; A47H 15/02; A47H 15/04; A47F 7/02

USPC ..... 211/85.3, 113, 119, 85.2; 160/330; 16/87 R, 87.2, 93 R, 93 D, 94 D, 95 D; D8/373, 370, 367; D6/580, 315, 317

See application file for complete search history.

(56) References Cited

U.S. PATENT DOCUMENTS

| | | | | | |
|---|---|---|---|---|---|
| 452,830 | A | * | 5/1891 | Bowie et al. | 224/220 |
| 1,332,533 | A | * | 3/1920 | Wordingham | 223/88 |
| 1,363,516 | A | * | 12/1920 | Kuhl | 24/599.6 |
| 2,011,662 | A | * | 8/1935 | Thompson | 4/558 |
| 3,339,745 | A | * | 9/1967 | Sugerman | 211/85.2 |
| D210,833 | S | * | 4/1968 | Cura | D6/320 |
| 3,592,343 | A | * | 7/1971 | Swett et al. | 211/123 |
| 4,217,986 | A | * | 8/1980 | Brown | 211/57.1 |
| 4,380,882 | A | * | 4/1983 | Flammini | 43/14 |
| 4,778,088 | A | * | 10/1988 | Miller | 223/91 |
| 4,966,287 | A | * | 10/1990 | Snyder | 211/85.2 |
| 5,101,877 | A | * | 4/1992 | Subecz et al. | 160/330 |
| 5,240,120 | A | * | 8/1993 | McDonough | 211/85.2 |
| D344,673 | S | * | 3/1994 | Effron | D8/373 |
| D357,441 | S | * | 4/1995 | Twentier | D12/133 |
| 5,509,528 | A | * | 4/1996 | Weisburn | 206/45.24 |
| 5,642,817 | A | * | 7/1997 | O'Brien | 211/60.1 |
| 5,771,504 | A | * | 6/1998 | Steiner | 4/558 |
| 5,894,642 | A | * | 4/1999 | Eberhardt | 24/716 |
| 6,164,617 | A | * | 12/2000 | Butterfield et al. | 248/690 |
| 6,206,209 | B1 | | 3/2001 | Houg-Brown | |
| D442,074 | S | * | 5/2001 | Harvey | D8/368 |
| 6,446,932 | B1 | * | 9/2002 | Butterfield et al. | 248/690 |
| D464,867 | S | * | 10/2002 | Samelson | D8/367 |
| 6,478,168 | B1 | * | 11/2002 | McNamee | 211/85.3 |
| 6,530,131 | B1 | * | 3/2003 | Hopkins | 24/300 |
| D510,854 | S | * | 10/2005 | DiMarchi et al. | D8/356 |

(Continued)

*Primary Examiner* — Korie H Chan

(74) *Attorney, Agent, or Firm* — James Ray & Assoc

(57) ABSTRACT

The fashion accessories hanging system has a group of hanger types including of open circle, open triangle, modified circle and flattened circle. The fashion accessory hangers are adapted to hold various fashion accessories. The user can select one or more any of the fashion accessory hangers or one or more of each of the fashion accessory hanger types. Another embodiment of the system includes a rod to place and remove the fashion accessory hangers. Another embodiment includes a c-shaped ring to prevent lateral movement of the hangers.

18 Claims, 7 Drawing Sheets

(56) References Cited

U.S. PATENT DOCUMENTS

D548,061 S * 8/2007 Hu ..... D8/370
7,322,554 B2 1/2008 Caroselli et al.
2011/0010891 A1* 1/2011 Rowley ..... 16/2.1
2011/0072578 A1* 3/2011 Chiao ..... 4/610

* cited by examiner

FASHION ACCESSORIES HANGING SYSTEM

CROSS REFERENCE TO RELATED APPLICATION

This patent application is related to and claims priority from U.S. 61/484,282 Provisional Patent Application Ser. No. filed May 10, 2011.

FIELD OF INVENTION

The present invention relates generally to fashion accessory hanging systems. More particularly the invention applies to customizable hanging systems with multiple components to accommodate different fashion accessories.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF INVENTION

It is well known in the field to provide apparatus for hanging belts an the like. For example, U.S. Pat. No. 5,642,817 issued to O'Brien is conventional arrangement. Also, U.S. Pat. No. 7,322,554 issued to Caroselli, et al. for hanging scarves is an example providing a particular apparatus for hanging accessories without compression.

OBJECTS OF INVENTION

An object of the invention is to provide a system with a variety of hangers for fashion accessories.

Another object of the invention is to provide a system having specialized hangers to hang fashion accessories without wrinkling.

Yet another object is to provide a system that collectively holds fashion accessories in one location.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

SUMMARY OF INVENTION

The present invention is a system of a variety of hangers for fashion accessories. The hangers have four varieties. The types of hangers are a group of open circle, open triangle, modified circle and flattened circle hangers. The open circle, open triangle and modified circle are circular in cross section. The flattened circle hanger has a circular top portion and a bottom portion with generally parallel front and rear surfaces and is rectangular in cross section. The flattened circle hanger includes a plurality of apertures for the user to hang clip or pierced ear rings. The user can select any of the types of hangers or several of each of the types of hangers. The hangers can be placed and removed from a rod without disturbing the fashion accessories.

BRIEF DESCRIPTION OF A PRESENTLY PREFERRED AND VARIOUS ALTERNATIVE EMBODIMENTS OF THE PRESENT INVENTION

Figure 1:
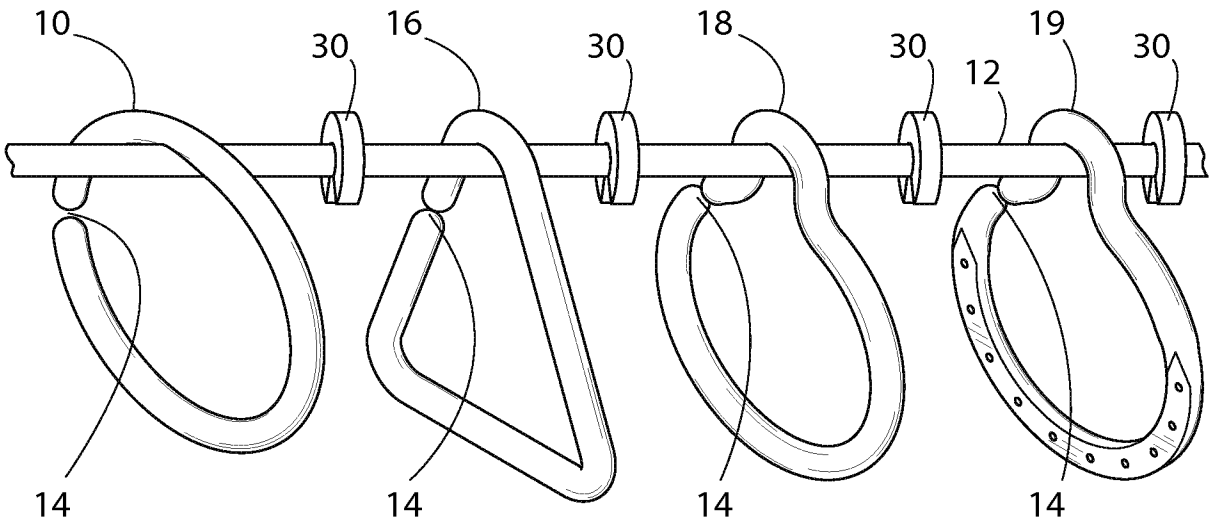
FIG. 1 is a perspective view of an embodiment of the invention.
Figure 2:
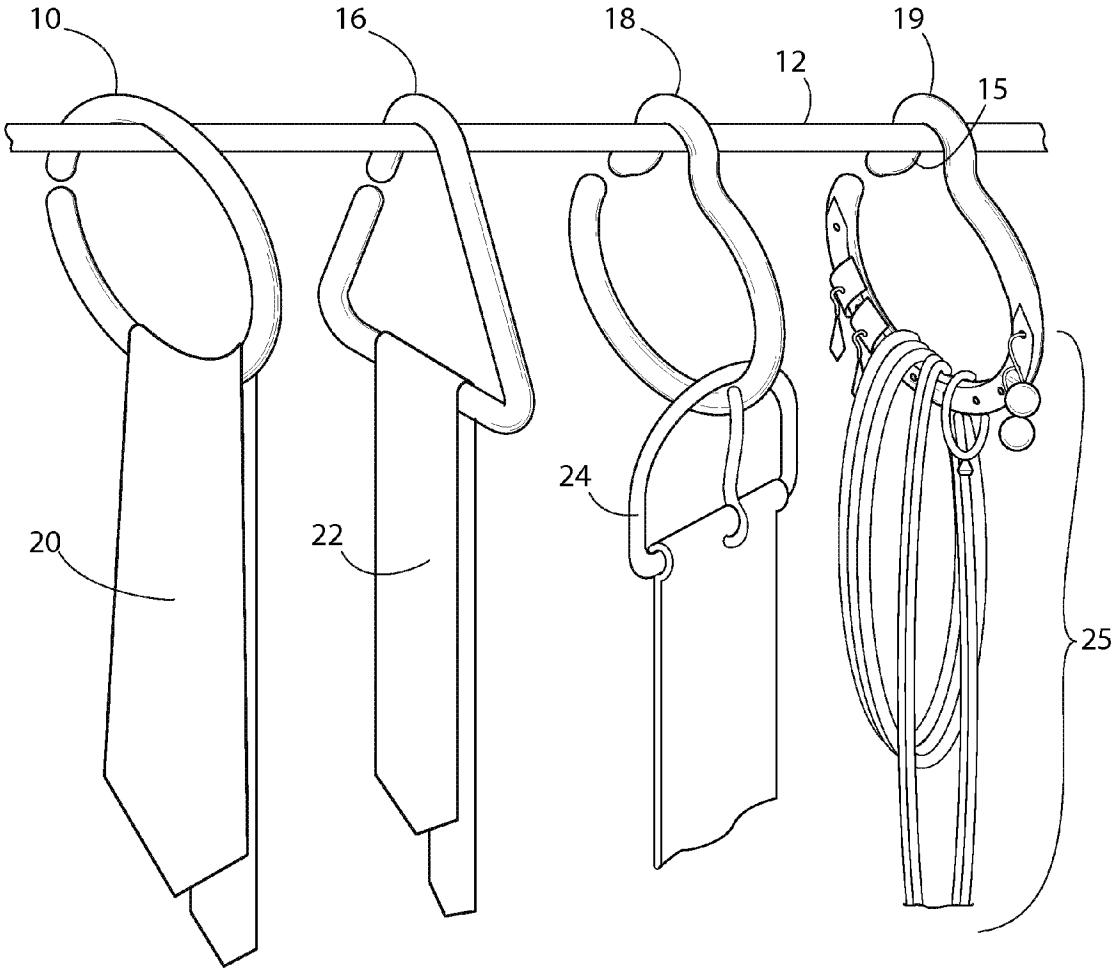
FIG. 2 is a perspective view of the fashion hangers with fashion accessories.
Figure 3B:
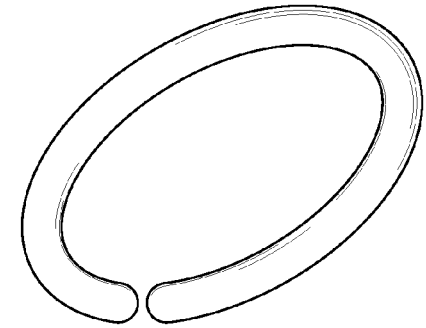
FIG. 3B is a perspective view of the open circle hanger.
Figure 3:
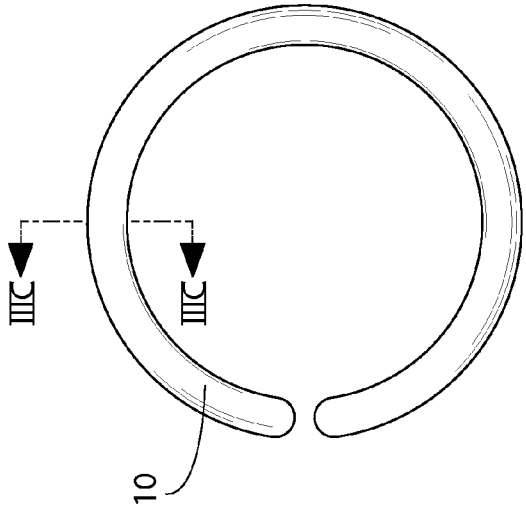
FIG. 3 is an elevation view of the open circle hanger.
Figure 3C:
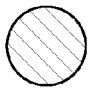
FIG. 3C is a cross section view through line IIIC-IIIC of FIG. 3.
Figure 3A:
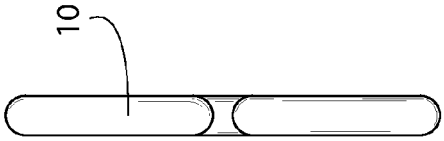
FIG. 3A is a side view of the open circle hanger.
Figure 4B:
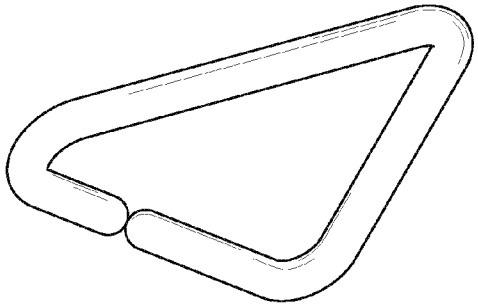
FIG. 4B is a perspective view of the open triangle hanger.
Figure 4:
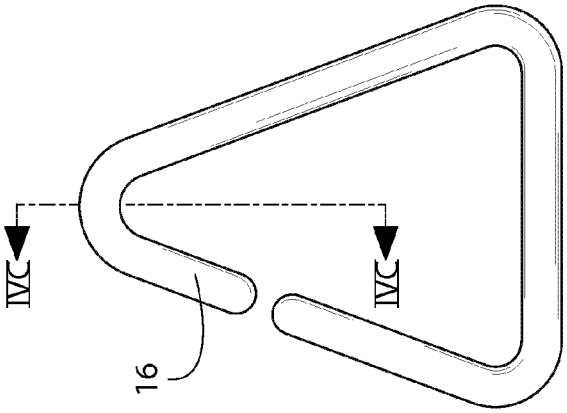
FIG. 4 is an elevation view of the open triangle hanger.
Figure 4C:
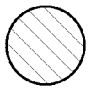
FIG. 4C is a cross section view of the open triangle hanger through line IVC-IVC of FIG. 4.
Figure 4A:
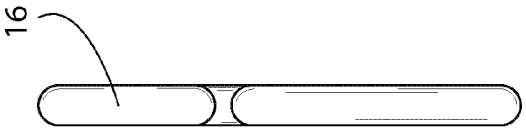
FIG. 4A is a side view of the open triangle hanger.
Figure 5A:
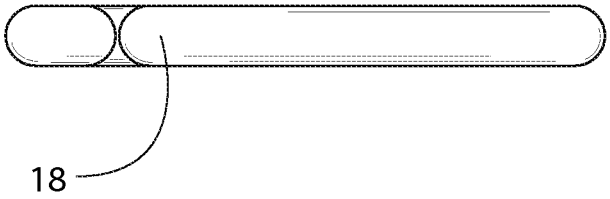
FIG. 5A is a side view of the modified circle hanger.
Figure 5B:
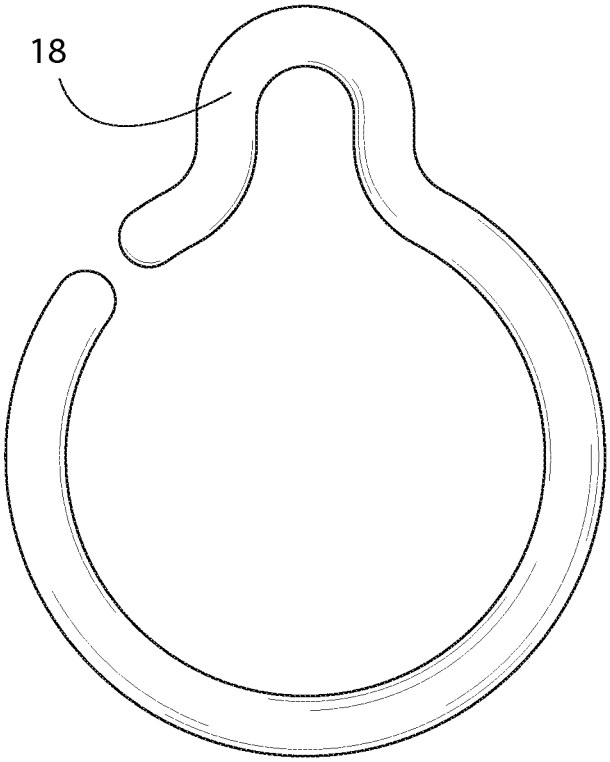
FIG. 5B is a perspective view of the modified circle hanger.
Figure 6B:
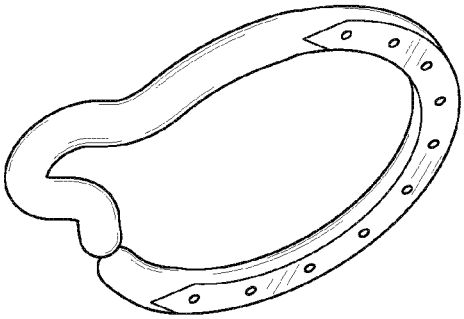
FIG. 6B is a perspective view of the flattened modified circle hanger.
Figure 6C:
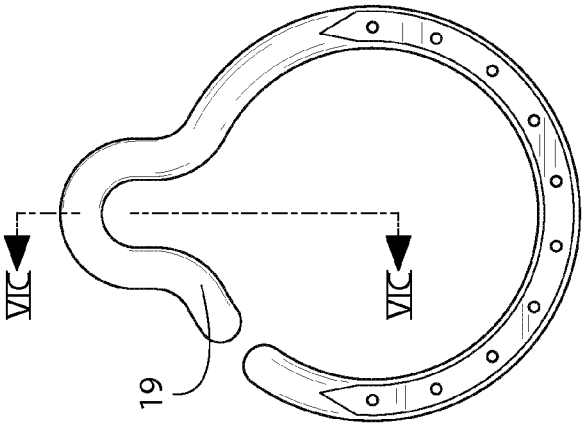
FIG. 6C is a cross section view of the flattened modified circle hanger through line VIC-VIC of FIG. 6.
Figure 6C:
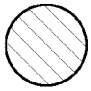
Figure 6A:
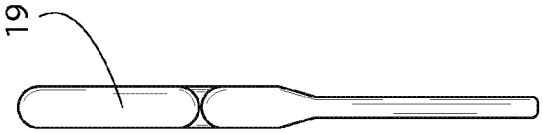
FIG. 6A is a side view of the flattened modified circle hanger.
Figure 6B:
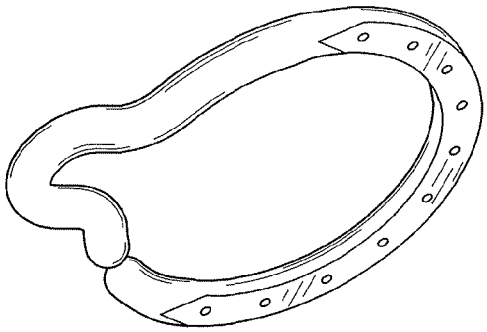
Figure 6:
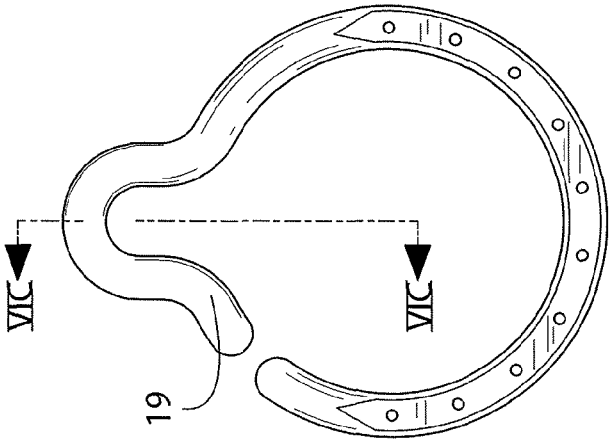
FIG. 6 is an elevation view of the flattened modified circle hanger.
Figure 6C:
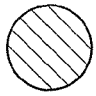
Figure 6A:
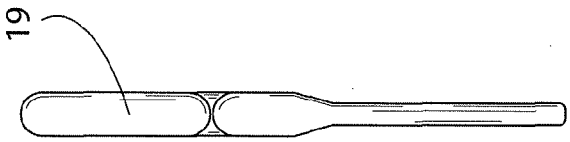

Prior to proceeding to the more detailed description of the present invention, it should be noted that, for the sake of clarity and understanding, identical components which have identical functions have been identified with identical reference numerals throughout the several views illustrated in the drawing figures. The system of the instant invention includes at least one and preferably four types of fashion accessory hangers. FIGS. 1 and 2 illustrates the following four types: an open circle 10, open triangle 16, modified circle 18 and a partially flattened circle 19. The fashion accessory hangers 10, 16, 18 and 19 each have a hollow interior, a top portion, bottom portion, closed portion and an open portion 14. The hollow interior essentially provides for generally uniform peripheral width of fashion accessory hangers 10, 16, 18 and 19 between interior and exterior thereof. Open circle 10, open triangle 16 and modified circle 18 are generally circular in cross section. Modified circle 18 has a circular section 15 in its top portion in open communication with hollow interior. Flattened circle 19 also has a circular section 15 in its top portion in open communication with hollow interior and a further has a bottom portion thereof adapted with a generally rectangular cross section with the front and rear surfaces generally parallel and spaced apart from each other to define thickness of such flattened bottom portion. Bottom flattened portion starts at about the middle of the flattened circle 19.

The open portion 14 is in a predetermined position. In the preferred embodiment such predetermined position is about ⅓ of the distance between the top portion and the bottom portion.

The open portion 14 has a spacing of between 0.10-1.0 inches. The presently preferred spacing is about 0.125 inches.

The open portion 14 has opposing ends. In the presently preferred embodiment the end shapes are hemispheric. However the end shape can be flat. Essentially, the open portion 14 defines a split in otherwise continuous shape of the each accessory hanger 10, 16, 18 and 19.

The open circle hanger 10 is adapted to hang scarves 20. The open triangle 16 is adapted to hold ties 22. The modified circle 18 is adapted to hold belts 24. The flattened circle 19 is adapted to hold jewelry, bracelets and earrings 25. The flattened circle 19 includes pluralities of apertures 26 formed in a spaced apart relationship with each other through a thickness of the flattened bottom portion and sized to receive the prongs of the earrings 25 used with pierced ears. The generally rectangular cross-section of the flattened bottom portion is provided so as to facilitate attachment of the clip-on style earrings 25. The generally rectangular cross-section of the flattened bottom may have rounded edges, thus defining a generally oval cross-section.

The system allows the user to select from group of the open circle 10, open triangle 16, modified circle 18 and flattened circle 19. The user can select one hanger or a plurality of hangers. The plurality of hangers can include one of any of the type of hangers and at least one other type of hangers. The plurality can be from one type or a mixture of hangers.

The fashion accessory hanging system in one embodiment includes only the fashion accessory hangers. Another embodiment has a support rod 12 to place the hangers. The support rod 12 could be defined by (is part of) a conventional hanger used to hang clothing. The circular section 15 of the modified circle 18 and flattened circle 19 is sized so as to receive the peripheral surface of the rod 12 therewithin. In use, the modified circle 18 and flattened circle 19 are suspended from the rod 12 by way of circular section 15.

Additionally, at least one c-shaped ring 30 is preferably sized to fit over rod 12 so as to provide a stop preventing the hangers from sliding when the rod 12 is tilted in the vertical plane or limiting other lateral movement on the rod 12 or other supporting surface. The c-shaped ring 30 may be also placed between a pair of hangers 10, 16, 18 and 19 so as to define a preselected spacing therebetween. The c-shaped ring 30 is manufactured preferably of an elastomeric material such as plastic or rubber, and has an inner surface thereof sized so as to securely engage the peripheral surface portion of the rod 12 yet allow for ease of removal from the rod 12. Furthermore, the material and/or shape of the c-shaped ring 30 define friction sufficient to prevent movement of the c-shaped ring 30 on the hanger 12. The instant invention contemplates that at least one c-shaped ring 30 may be attached directly to at least one of the plurality of hangers 10, 16, 18 and 19 so as to provide spacing between the fashion accessories hung from such hanger. The instant invention also contemplates that an inner edge surface of the modified circle 18 and/or flattened circle 19 may be optionally provided with raised portions (not shown) so as to facilitate arrangement of necklaces.

Additionally, the hangers 10, 16, 18 and 19 can be hung on a hook, nail, stud, peg, door knob or other suitable parts or surface (not shown).

It would be understood, that although FIGS. 1 and 2 show four different hanger types disposed on one rod 12, the instant invention also contemplates that the user of the system may elect to suspend a plurality of the same hanger type from one rod 12. By way of one example only, the user may elect to use only a plurality of modified circles 19 when the user is only concerned with earring 25.

Although the present invention has been shown in terms of use with fashion accessory items, it will be apparent to those skilled in the art, that the present invention may be used for hanging other items, for example such as medals with ribbons, key chains, badges with lanyards and the like.

While in accordance with the patent statutes the presently preferred and various alternative embodiments of the instant invention have been described in detail above, it should be understood that various other modifications and alternatives can be envisioned by those persons skilled in the art without departing from either the spirit of the invention or the scope of the appended claims.

I claim:

1. A fashion accessory hanging system comprising:

a quantity of open circle hangers having a generally circular shape and a generally circular cross section, a quantity of open triangle hangers having a generally triangular shape and a generally circular cross section, a quantity of modified circle hangers having a circular portion and a generally partial oval portion, a quantity of flattened circle hangers having a generally circular shape, and a generally circular cross section portion and a generally oval cross section with a reduced thickness, said oval cross section portion having a plurality of apertures formed through said reduced thickness, each of said open circle hangers, open triangle hangers, modified circle hangers, and flattened circle hangers having a top portion, a bottom portion and an open portion, said open portion positioned at a predetermined position between said top and said bottom portions, and said top and bottom portions define a closed portion, and said open portion in said each of said open circle hangers, open triangle hangers, modified circle hangers, and flattened circle hangers having opposing ends with a predetermined shape and a predetermined spacing.

2. A fashion accessory hanging system according to claim 1 where said predetermined position of said open portion is about one third (⅓) of the distance between the top and the bottom portions of said each hanger.

3. A fashion accessory hanging system according to claim 1 where said predetermined shape of said open portion ends are hemispheric.

4. A fashion accessory hanging system according to claim 1 where said predetermined shape of said open portion ends are flat.

5. A fashion accessory hanging system according to claim 1 where said predetermined spacing between said open portion ends is about 0.125 inches.

6. A fashion accessory hanging system according to claim 1 where said predetermined spacing between said open portion ends is between about 0.010 and about 0.50 inches.

7. A fashion accessory hanging system according to claim 1 with a support rod on which to hold said open circle hangers, open triangle hangers, modified circle hangers, and flattened circle hangers.

8. A fashion accessory hanging system according to claim 1 where said quantity of each of said open circle hangers, open triangle hangers, modified circle hangers, and flattened circle hangers is one.

9. A fashion accessory hanging system according to claim 1 where said quantity of at least one of said open circle hangers, open triangle hangers, modified circle hangers, and flattened circle hanger is a plurality.

10. A fashion accessory hanging system according to claim 1, further comprising at least one c-shaped ring to prevent a lateral movement of said open circle hangers, open triangle hangers, modified circle hangers, and flattened circle hangers.

11. A fashion accessory hanging system according to claim 10 where said c-shaped ring is manufactured from an elastomeric material selected from the group of plastic and rubber.

12. A fashion accessory hanging system comprising:

an open circle hanger, having a generally circular shape and a generally circular cross section, an open triangle hanger having a generally triangular shape and a generally circular cross section, a modified circle hanger have a circular portion and a generally partial oval portion, a flattened circle hanger having a generally circular shape, a generally circular cross section portion and a generally oval cross section portion, said oval cross section portion having a thickness thereof being smaller than a thickness of said generally circular cross section portion, said oval cross section portion further having a plurality of apertures formed through said thickness thereof, each of said open circle hanger, said open triangle hanger, said modified circle hanger and said flattened circle hanger further having a hollow interior and a generally uniform width between an interior and an exterior edges of said at least one fashion accessory hanger, said each of said open circle hanger, said open triangle hanger, said modified circle hanger and said flattened circle hanger further having a top portion, a bottom portion and an open portion, said open portion positioned at a predetermined position between said top and bottom portions, and said open portion having opposing ends with a predetermined shape and a predetermined spacing.

13. The fashion accessory hanging system of claim 12, further including a rod shape member and at least one c-shaped ring, wherein said each hanger and said c-shaped ring is adapted for mounting on said rod member.

14. A hanging system comprising:

at least one hanger, said at least one hanger having a generally continuous shape, said at least one hanger having a hollow interior defining a generally uniform width between interior and exterior of said at least one hanger, and said at least one hanger having a top portion, a semi-circular bottom portion and a split positioned proximal to said top portion, said top portion being smaller than said semi-circular bottom portion when said at least one hanger is in use, where said semi-circular bottom portion has a generally oval cross-section with a reduced thickness and apertures formed through said reduced thickness.

15. The hanging system of claim 14, further including a rod shape member and at least one c-shaped ring, wherein said at least one hanger and said at least one c-shaped ring is adapted for mounting on said rod member.

16. The hanging system of claim 12, wherein a width of said top portion in each of said modified circle hanger and said flattened circle hanger is smaller than a width of said bottom portion in said each of said modified circle hanger and said flattened circle hanger when said modified circle hanger and said flattened circle hanger are positioned for use.

17. The hanging system of claim 12, wherein said open portion is positioned proximal said top portion when said each hanger is positioned for use.

18. The hanging system of claim 1, wherein said fashion accessory hanger having said flattened circle is configured to facilitate attachment of clip-on style earrings and wherein said plurality of apertures formed through said flattened circle receives prongs of earrings used with pierced ears.

* * * * *